US006791504B1

(12) United States Patent
Miller et al.

(10) Patent No.: US 6,791,504 B1
(45) Date of Patent: Sep. 14, 2004

(54) TUNABLE ANTENNA SYSTEM

(75) Inventors: Paul E. Miller, Spring Lake, MI (US); Robert M. Lynas, Spring Lake, MI (US); John Jeremy Churchill Platt, Grand Haven, MI (US)

(73) Assignee: R. A. Miller Industries, Inc., Grand Haven, MI (US)

( * ) Notice: Subject to any disclaimer, the term of this patent is extended or adjusted under 35 U.S.C. 154(b) by 1 day.

(21) Appl. No.: 10/249,044

(22) Filed: Mar. 12, 2003

(51) Int. Cl.[7] ..... H01Q 9/00
(52) U.S. Cl. ..... 343/750; 343/715; 343/745
(58) Field of Search ..... 343/715, 749, 343/751, 895, 702, 745, 750

(56) References Cited

U.S. PATENT DOCUMENTS

| | | | | |
|---|---|---|---|---|
| 3,824,600 A | * | 7/1974 | Majkrzak et al. | 343/895 |
| 4,152,705 A | | 5/1979 | Kowols | |
| 4,163,981 A | | 8/1979 | Wilson | |
| 4,214,247 A | | 7/1980 | Richmond | |
| 4,379,298 A | | 4/1983 | Vincent et al. | |
| 4,460,896 A | | 7/1984 | Shmitka | |
| 4,620,194 A | * | 10/1986 | Bel Moratalla | 343/747 |
| 5,187,488 A | | 2/1993 | Van Der Vis | |
| 5,349,700 A | | 9/1994 | Parker | |
| 5,955,996 A | | 9/1999 | Clubb | |
| 6,239,751 B1 | | 5/2001 | Mc Rae et al. | |
| 6,333,719 B1 | | 12/2001 | Varadan et al. | |
| 6,400,336 B1 | | 6/2002 | Gleener | |
| 6,657,598 B2 | * | 12/2003 | Tulloch | 343/765 |

* cited by examiner

*Primary Examiner*—Tho Phan
(74) *Attorney, Agent, or Firm*—McGarry Bair PC

(57) ABSTRACT

A tunable antenna system includes an antenna, a tuning mechanism, and a key that relates points of adjustment in the tuning mechanism to different installations of the antenna. The antenna can be tuned for a given installation by applying the key to the antenna without specialized knowledge or equipment. The system also includes a set of tunable antennas, each being tunable within a different range of electrical lengths. The number of antennas in the set is sufficient to cover a total range of electrical lengths for a given set of installations. Fewer antennas are needed to provide a tuned antenna for each installation.

18 Claims, 6 Drawing Sheets

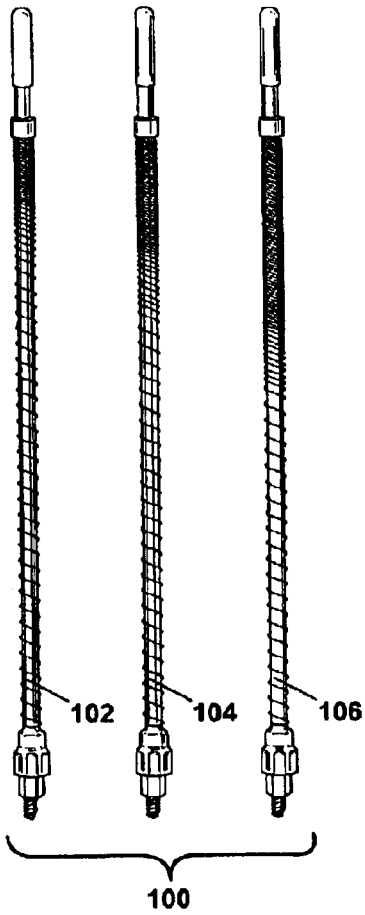
Fig. 6A
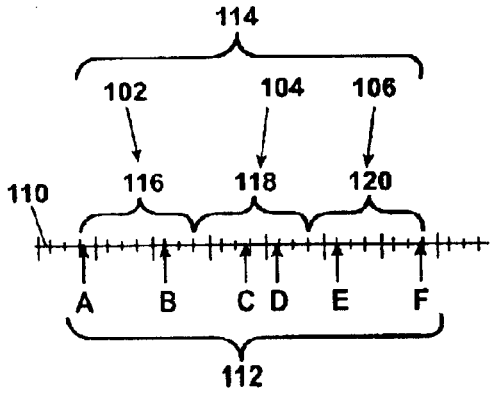
Fig. 6B
| Model | Antenna |
|---|---|
| A | 102 |
| B | 102 |
| C | 104 |
| D | 104 |
| E | 106 |
| F | 106 |
Fig. 6C

TUNABLE ANTENNA SYSTEM

BACKGROUND OF INVENTION

1. Field of the Invention

The invention relates to antennas and more particularly to tunable antennas, especially for, but not limited to, vehicles.

2. Description of the Related Art

Most commercial trucks carry one or more antennas, the most common being AM/FM and citizen's band (CB) antennas. The wide variety of vehicles and the number of different types of antennas available aggravate the problem of optimizing the performance of a given antenna on a given vehicle. Tuning is especially important for transmitting antennas such as CB. Ideally, each antenna will be tuned to the vehicle on which it is installed, but the requirement for specialized knowledge of antenna tuning and the labor cost in doing so make it impractical. As a compromise solution, some antennas are typically manufactured to design specifications at a particular frequency relative to a predetermined frequency range. For example, CB antennas are often factory tuned to a frequency at or below the CB frequency range of 26.95 to 27.405 MHz in order to allow tuning after installation by shortening the electrical length of the antenna. Tuning, in this sense, means causing the antenna to resonate at a desired frequency.

One problem with a pretuned antenna is that the ground plane upon which the antenna is tuned at the factory usually does not accurately reflect the actual ground plane presented by, the vehicle to which the antenna is ultimately installed. As a result, there may be significant signal degradation in the installation away from the pretuned frequency, even to the extent that an antenna cannot be tuned to a desired frequency on a vehicle. In other words, for example, a pretuned CB antenna installed on a vehicle may resonate completely outside the CB frequency range. The prior art has presented a solution to this additional problem by providing tunable antennas whereby after installation, an individual antenna can be tuned to the specific ground plane upon which it is installed. It is known to tune an antenna by changing its electrical length. Available techniques include physically shortening the antenna, e.g., by cutting the end off an antenna, and changing the inductance of a top load, e.g., by moving a slide or a screw in or out of the end of an antenna.

Yet there remains a problem in that there are many models of antennas needed to service all existing models of commercial vehicles at desired resonant frequencies. For example, in North America, there are approximately 40 different models of trucks, each presenting a significantly different ground plane for antennas. Moreover, many new models have fiberglass cabs, which further complicate the problems of providing a properly tuned antenna for vehicles. One can conceive, theoretically, a single tunable antenna that would accommodate the range of different electrical lengths needed for the antenna to resonate at a given frequency regardless of the vehicle on which it is installed. As a practical matter, however, especially for CB antennas, there is no single tunable antenna that can provide enough tuning range to handle all field needs for tuning the antennas to a resonant frequency on all available truck models. One of the principal reasons is that the physical requirements for such an antenna would weaken the antenna or otherwise render it impractical for use in the field. Consequently, especially in the aftermarket for CB antennas, manufacturers and sellers must provide many different tunable antennas to accommodate all of the needs. Moreover, there is also the continuing problem that tuning antennas in the field requires specialized knowledge that may not be available to a user for properly tuning an antenna after installation.

SUMMARY OF INVENTION

These problems are solved by the present invention of a tunable antenna system comprising an antenna, a tuning mechanism to adjust the electrical length of the antenna, and a key that relates points of adjustment in the tuning mechanism to a data set. Each datum of the data set represents a predetermined installation of the antenna, each installation requiring that the antenna be tuned to a predetermined resonant frequency. Thus, when the antenna is installed in a given installation, it can be tuned to the predetermined resonant frequency by application of the key to the tuning mechanism without specialized knowledge or specialized equipment.

In one embodiment, the key comprises indicia on the antenna. The tuning mechanism can be one comprising two components, one of which moves relative to the other, and the indicia can be on one of the components.

In another embodiment, the key is separate from the antenna. The key can be a guide, or the key can be a gauge corresponding to an installation, that when applied to the antenna will identify the corresponding point of adjustment. The key itself can be on the antenna, such as, for example, when the data set comprises indicia on the antenna.

A method of tuning an antenna in a such tunable antenna system comprises the steps of consulting the key, identifying a point of adjustment corresponding to an installation, and adjusting the tuning mechanism to the point of adjustment. Preferably, the predetermined resonant frequency is in the range of 26.95 to 27.405 MHz.

In another aspect of the invention, a tunable antenna system comprises a set of tunable antennas and a data set. Each antenna of the set is tunable within a range of electrical lengths, and each datum of the data set represents an installation of the antenna. The ranges of electrical lengths are sufficient to provide resonant frequencies for all installations in the data set. The number of ranges is less than the number of installations. Thus, fewer antennas are needed than installations possible to provide a tuned antenna for each installation.

Preferably, the set of installations comprises different models of vehicles, such as trucks. Also, preferably, the resonant frequency is in the range of 26.95 to 27.405 MHz.

BRIEF OF DESCRIPTION OF DRAWINGS

FIG. 6*a* is schematic diagram of a set of tunable antennas in a tunable antenna system according the invention.

FIG. 6*b* is a graphical illustration relating the number of antennas needed to cover electrical lengths for given installations.

FIG. 6*c* is a table illustrating the applicability of the set of tunable antennas of FIG. 6*a* to a selection of vehicles, all according to the invention.

DETAILED DESCRIPTION

Figure 1:
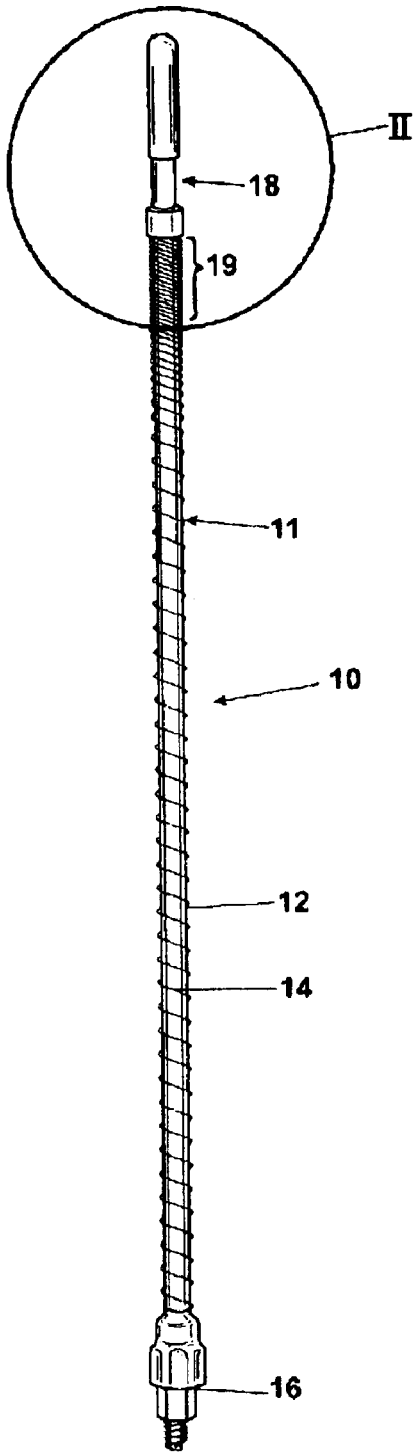
FIG. 1 is an elevational view of a tunable antenna system according to the invention.
Figure 2:
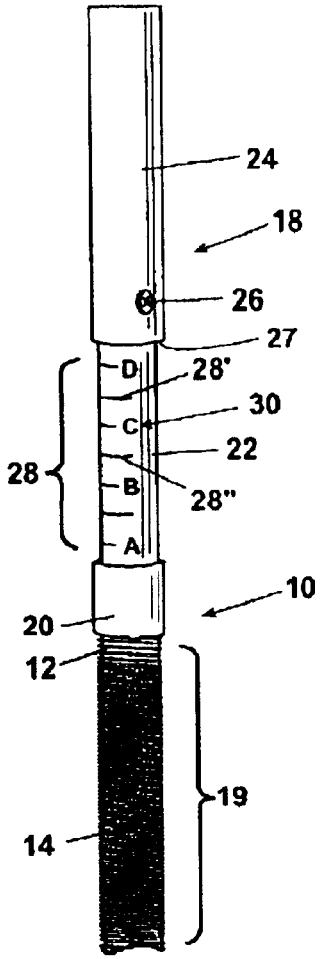
FIG. 2 is an enlarged view of the area of the antenna bounded by 11 in FIG. 1.

Looking first at FIGS. 1 and 2, an embodiment of a tunable antenna system according to the invention is generally referenced at 10. The antenna system 10 comprises an antenna 11 having an elongated fiberglass core 12, around which is wrapped an insulated copper wire 14, running from a base 16 to a tuning mechanism 18. In this embodiment, the antenna 11 is top loaded, i.e., a section 19 of the coiled wire 14 at the upper end adjacent the tuning mechanism 18 is tightly coiled, effectively increasing the electrical length of the antenna. It will be understood that top loading is not essential to the invention. Rather, top loading is illustrated here because it is highly common in vehicle antennas where it is necessary to provide a longer electrical length in a shorter antenna, and particularly antennas in the citizen's band frequency range.

The tuning mechanism 18 is shown more clearly in FIG. 2. It comprises a collar 20, preferably brass, and a conductive extender 22, preferably also brass, extending therefrom. The wire 14 is electrically connected to the extender 22. A conductive tuning slide 24 is telescoped over the conductive extender 22 and movable relative thereto. The slide 24 carries a setscrew 26 near a proximal edge 27 by which the tuning slide 24 can be fixed relative to the extender 22. It will be understood that moving the slide 24 relative to the extender 22 will change the effective electrical length of the antenna 10, altering the tuning frequency, i.e., the frequency at which the antenna 11 will resonate. Typically this is the frequency at which optimal performance is realized, especially in a transmitting antenna.

In accordance with the invention, indicia 28 are located on the extender 22. Each indicium 28 corresponds to a predetermined criterion related to tuning the antenna 11. For example, indicium 28' will correspond to a particular electrical length of the antenna or a particular frequency at which the antenna will resonate if the proximal edge 27 is aligned with the indicium 28' and the slide 24 is secured at that point. Indicium 28" will correspond to a different electrical length of the antenna or a different frequency at which the antenna will resonate if the proximal edge 27 is aligned with the indicium 28", and slide 24 is secured at that point.

Also located on the extender is a key 30 comprising another set of indicia related to a data set. The data set comprises possible installations of the antenna, such as different vehicles and/or vehicle models. Thus, for example, key A may correspond to vehicle A, key B may correspond to vehicle B, etc. Each key has been predetermined to identify where the tuning mechanism 18 must be set to obtain resonant frequency for the antenna 11 installed on the corresponding vehicle. In use, an individual wishing to install the antenna 11 on vehicle C, for example, will slide the tuning slide 24 until the proximal edge 27 is aligned with the key C on the extender 22, and secure the tuning slide to the extender by the setscrew 26. When installed, the antenna will automatically be tuned to the resonant frequency and optimal performance can be achieved without further adjustments. No special equipment or knowledge is needed.

It will be understood that the indicia 28 are not really necessary for the invention; the indicia 28 correspond to various criteria of the antenna itself. The keys 30, however, relate the data set (in this case various vehicles) to an optimum resonant frequency of the antenna 11.

Figure 3:
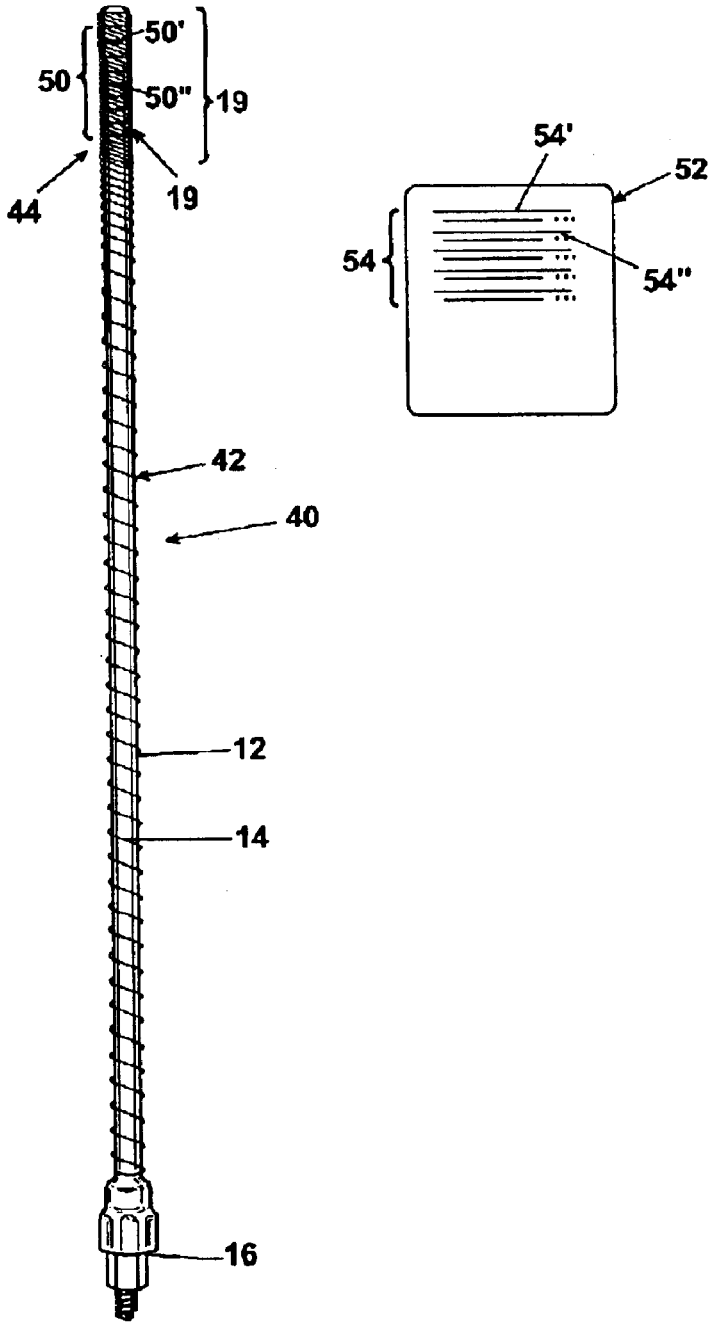
FIG. 3 is another embodiment of a tunable antenna system according to the invention.

Moreover, the manner of tuning an antenna according to the invention is irrelevant. Any mode of changing the effective electrical length of the antenna will tune the antenna. FIG. 3 illustrates a very simple tuning mechanism in an antenna system 40 according to the invention, where components identical to those in FIG. 1 bear like numerals. The antenna 42 in FIG. 3 has a wrapped copper wire 14 on a fiberglass core 12. A top loaded section 19 of the wire 14 is at the upper end of the antenna. Here, the tuning mechanism 44 comprises removing portions of the top section 19, either removing coils of the wire 14, or removing both the coils and the portions of the fiberglass core 12. Such removal changes the electrical length of the antenna 42, causing it to resonate at a different frequency. In accord with the invention, indicia 50 are provided on the top load section 19 to indicate where removal should take place for given tuning. The indicia 50 may be in form of score lines to facilitate easier removal. For example, indicium 50' will correspond to a particular electrical length of the antenna or a particular frequency at which the antenna will resonate if the portion of the wire 14 and/or fiberglass core 12 above that indicium is removed. Indicium 50" will correspond to a different electrical length of the antenna or a different frequency at which the antenna will resonate If the portion of the wire 14 and/or fiberglass core 12 above that indicium is removed.

A guide 52 is also provided that contains a key 54 to the indicia 50 on the antenna 42. Since the key 54 is largely a list of data (i.e., a data set), the guide 52 can be in any form suitable to a database, from a printed list to an electronic display, such as might be downloadable to a handheld computer. Here, the key 54 will typically comprise a list of vehicles and/or vehicle models related to the indicia 50 on the antenna 42. To illustrate this aspect of the invention, say that key element 54' in the guide 52 identifies the indicium 50' for a first model of a particular vehicle, and key element 54" identifies the indicium 50" corresponding to a second model. An individual wishing to install the antenna 42 on the first model of a particular vehicle, for example, will go to the guide 52, and identify the key element 54' corresponding to the first model of a particular vehicle. The key will identify an Indicium 50' for appropriate tuning, so that the user has only to remove the portion of the wire 14 and/or fiberglass core 12 above that indicium to tune the antenna for that model of a particular vehicle. When installed, the antenna 42 will automatically be tuned to the resonant frequency and optimal performance can be achieved without further adjustments. No special equipment or knowledge is needed. Similarly, an individual wishing to install the antenna 42 on the second model of a particular vehicle will go to the guide 52, and identify the key 54" corresponding to the second model of a particular vehicle. The key will identify an indicium 50" for appropriate tuning, so that the user has only to remove the portion of the wire 14 and/or fiberglass core 12 above that indicium to tune the antenna for that model. When installed, the antenna 42 will automatically be tuned to the resonant frequency and optimal performance can be achieved without further adjustments. No special equipment or knowledge is needed.

Figure 4:
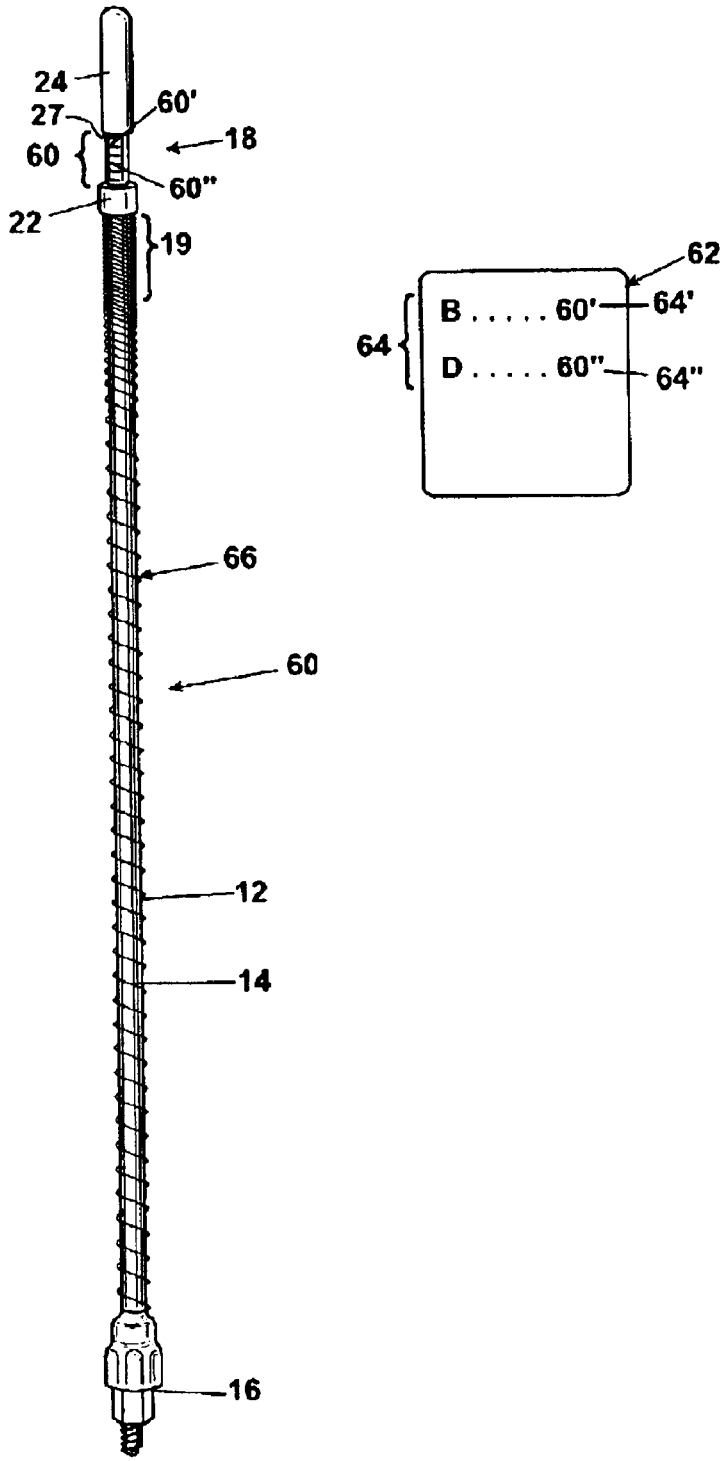
FIG. 4 is third embodiment of a tunable antenna system according to the invention.

FIG. 4 illustrates schematically another embodiment of an antenna system 60 according to the invention. Antenna system 60 is similar to the antenna system 10 of FIG. 1, and like components bear like numerals. Here, however, instead of a key 30 being on the antenna 11 as shown in FIGS. 1 and 2, a guide 62 carries a key 64 separately from the antenna 66. Here, a user can utilize the guide 62 in the same manner as the guide 52 in FIG. 3, and tune the antenna in the same manner as the tunable antenna 11 of FIGS. 1 and 2. An individual wishing to install the antenna 66 on vehicle model B, for example, will go to the guide 62, and search the key 64 for data about vehicle model B. The key 64 contains key element 64' that shows indicium 60' corresponding to vehicle model B. The user will slide the tuning slide 24 until the proximal edge 27 is aligned with the indicium 60' on the extender 22, and secure the tuning slide to the extender. When installed on vehicle model B, the antenna 66 will automatically be tuned to the resonant frequency and optimal performance can be achieved without further adjustments. No special equipment or knowledge is needed. Similarly, an individual wishing to install the antenna 66 on vehicle model D will go to the guide 62, and search the key 64 for data about vehicle model D. The key 64 contains key element 64" that shows indicium 60" corresponding to vehicle model D. The user will slide the tuning slide 24 until the proximal edge 27 is aligned with the indicium 60" on the extender 22, and secure the tuning slide to the extender. When installed on vehicle model D, the antenna 66 will automatically be tuned to the resonant frequency and optimal performance can be achieved without further adjustments. No special equipment or knowledge is needed.

It will be apparent that with a tunable antenna according to the invention, an untrained person, using only a key according to the invention, can tune the antenna for a given installation accurately and without the need for additional equipment, such as a VSWR meter. As well, the invention may be accomplished with a variety of types and locations of indicia and/or keys. For example, the indicia 28 in the embodiment of FIG. 1 can be located on the slide 24 versus the extender 22. The indicia 50 in FIG. 3 can be painted lines on the fiberglass whip 12 or colored portions of the wire 14. The indicia can be numerals or letters, color codes, or marks directly indicating in a given language the key corresponding to the given indicium. As well, the indicia can be separate markers or devices that indicate where the tuning mechanism should be adjusted for optimum performance according to a particular criterion.

Figure 5:
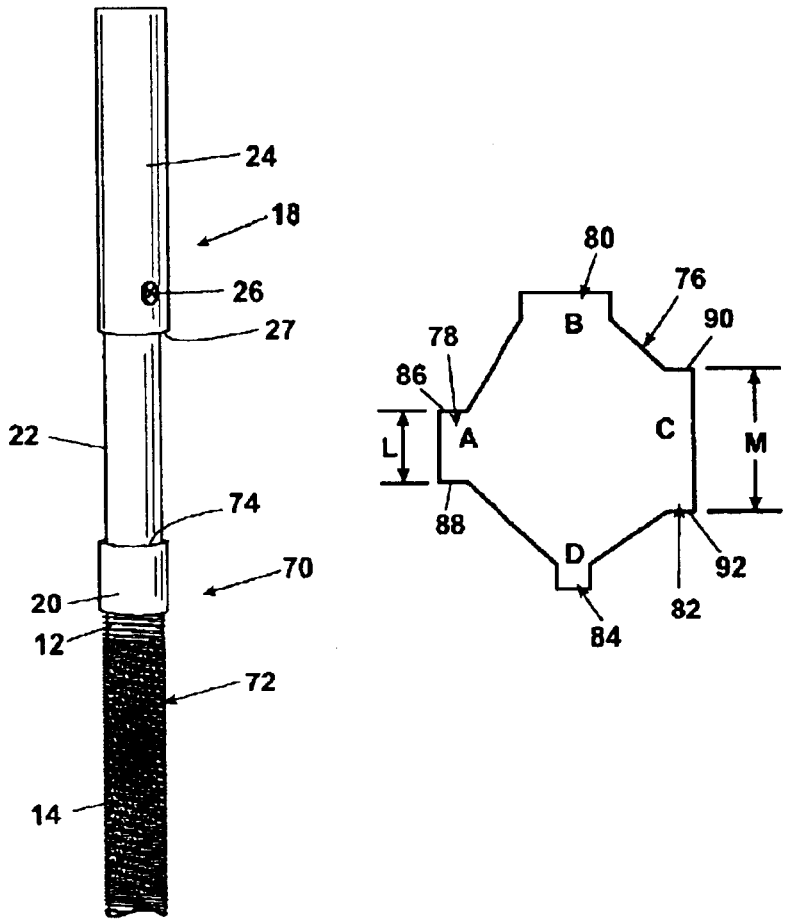
FIG. 5 is fourth embodiment of a tunable antenna system according to the invention.

FIG. 5 illustrates another embodiment showing such an exemplary variation in the key, where components identical to those of FIGS. 1 and 2 carry like numerals. The antenna system 70 in FIG. 5 comprises an antenna 72 formed of an insulated wire 14 wound around a fiberglass core 12. The wire 14 is electrically connected to a conductive extender 22 and the tuning mechanism comprises a slide 24 movably telescoped over the extender 22. The collar 20 has a distal edge 74 that faces the proximal edge 27 of the slide 24. The system 70 includes a key 76 having a number of gauges 78, 80, 82, and 84, each gauge corresponding to a particular model of vehicle, A, B, C, and D, respectively. Gauge 78 comprises a first edge 86 spaced from a second edge 88 a distance L. Distance L is predetermined to be the distance that the proximal edge 27 must be from the distal edge 74 on the tuning mechanism for the antenna 72 to be tuned when installed on vehicle A. Similarly, gauge 82 comprises a first edge 90 spaced from second edge 92 a distance M. Distance M is predetermined to be the distance that the proximal edge 27 must be from the distal edge 74 on the tuning mechanism for the antenna 72 to be tuned when Installed on vehicle C.

An individual wishing to install the antenna 72 on vehicle A, for example, can tune the antenna for vehicle A in the following manner. Gauge 78, corresponding to vehicle A, is set against the extender 22, and the slide 24 is moved over the extender 22 until the proximal edge 27 of the slide abuts the first edge 86 of the gauge and the distal edge 74 of the collar 20 abuts the second edge 88 of the gauge. The slide 24 is secured to the extender 22 at that position as described above or in any conventional manner. When the antenna 72 is later installed on vehicle A, it is automatically be tuned to the resonant frequency, and optimal performance can be achieved without further adjustments. No special equipment or knowledge is needed. For tuning to vehicle C instead of vehicle A, gauge 82, corresponding to vehicle C, is set against the extender 22, and the slide 24 is moved over the extender 22 until the proximal edge 27 of the slide abuts the first edge 90 of the gauge and the distal edge 74 of the collar 20 abuts the second edge 92 of the gauge. The slide 24 is secured to the extender 22 as described above or in any conventional manner. When the antenna 72 is then installed on vehicle C, it will automatically be tuned to the resonant frequency, and optimal performance can be achieved without further adjustments. No special equipment or knowledge is needed.

Another aspect of an antenna system according to the invention is illustrated in FIGS. 6*a*–6*c*. FIG. 6*a* shows a set 100 of individual tunable antennas 102, 104, and 106. Each antenna has a base electrical length and a tuning mechanism that enables the electrical length to be changed within a given range of adjustment. Thus, antenna 102 has an electrical length of x +x', where x is the base electrical length and the x' is the range of adjustment. Similarly, antenna 104 has an electrical length of y +y' and antenna 106 has an electrical length of z +z'. Each range of adjustment is determined by the practical limitations of a tuning mechanism. For some tuning mechanisms, the range of adjustment will only be negative because for those one can only shorten the electrical length. In other tuning mechanisms, the range may be positive or negative relative to the base electrical length because one may lengthen or shorten the electrical length. In still others, one may only lengthen the electrical length so the range will be only positive.

In one embodiment, a predetermined set of criteria comprises a total range of electrical lengths needed to accommodate tuning the antennas to the same resonant frequency for a given set of installations, such as a variety of truck models. The number of antennas needed for the set 100 must be enough to cover the total range of the predetermined criteria. This is graphically illustrated in FIG. 6*b* where a line 110 represents possible electrical lengths of antennas. Points on the line 110 represent a given set of installations 112, e.g., the electrical lengths that are needed to tune antennas for specific truck models. Thus point A represents the electrical length needed to tune an antenna for truck model A, point B corresponds to truck model B, etc. The total range 114 thus represents the range of adjustment needed in an antenna to accommodate tuning all antennas in the installation set 112. Because no single tunable antenna can practically cover the total range 114, the total range is divided into a subset of adjustment ranges 116, 118, and 120, each subset being covered by the adjustable electrical lengths of the antennas 102, 104, and 106, respectively. It will be understood that the range of electrical lengths for each antenna may overlap. In other words for example, antenna 102 may be tunable within a range of electrical lengths that, in addition to the whole of adjustment range 116, might encompass part of adjustment range 118, but not the whole of It. To cover the whole of adjustment range 118, one will need antenna 104, which might also encompass part of adjustment ranges 116 and 120, but not the whole of them.

The practical benefit of an antenna system according to the invention is best illustrated in the table of FIG. 6*c* where each of truck models A–F can have an antenna tuned to the same resonant frequency using the antennas from the set 100. However, instead of having six different antennas, each pretuned for corresponding truck model, a set 100 of fewer antennas can accommodate tuning for all of the truck models. It will be apparent that with the invention a fewer number of antennas need be manufactured and stocked than would otherwise be required in order to provide antennas capable of tuning to a resonant frequency for different installations. A practical application is in the availability of CB antennas for the aftermarket of commercial trucks. Instead of having 40 or more different antennas to accommodate the variety of installations required to achieve resonant frequency in the CB range for the different truck models, a set of two or more tunable antennas may be sufficient to accommodate all installations. Preferably, each antenna 102–106 will be provided with a key in order to properly tune the antenna in a given installation without specialized knowledge or equipment. It will be understood that the number of antennas in the set 100 is by way of illustration only, and that the number of antennas in a given set is not limited to three as illustrated.

While the invention has been specifically described in connection with certain specific embodiments thereof, it is to be understood that this is by way of illustration and not of limitation, and the scope of the appended claims should be construed as broadly as the prior art will permit.

What is claimed is:

1. A tunable antenna system comprising an antenna, a tuning mechanism to adjust the electrical length of the antenna, and a key that relates points of adjustment in the tuning mechanism to a data set, wherein each datum in the data set represents a predetermined installations of the antenna, each installation requiring that the antenna be tuned to a predetermined resonant frequency for optimum performance, whereby when the antenna is installed in a installation, it can be tuned to the predetermined resonant frequency by application of the key to the tuning mechanism without specialized knowledge or specialized equipment.

2. A tunable antenna system according to claim 1 wherein the key comprises indicia on the antenna.

3. A tunable antenna system according to claim 2 wherein the tuning mechanism comprises two components, one of which moves relative to the other, and the indicia are on one of the components.

4. A tunable antenna system according to claim 2 wherein the data set comprises indicia on the antenna.

5. A tunable antenna system according to claim 4 wherein the tuning mechanism comprises two components, one of which moves relative to the other, and the indicia are on one of the components.

6. A tunable antenna system according to claim 1 wherein the key is separate from the antenna.

7. A tunable antenna system according to claim 6 wherein the key comprises a guide.

8. A tunable antenna system according to claim 7 wherein the guide is printed.

9. A tunable antenna system according to claim 7 wherein the guide is displayed electronically.

10. A tunable antenna system according to claim 6 wherein the key comprises at least one gauge corresponding to an installation, that when applied to the antenna will identify the corresponding point of adjustment.

11. A tunable antenna system according to claim 10 wherein the key comprises four gauges.

12. A tunable antenna system according to claim 10 wherein the at least one gauge comprises a first edge spaced from a second edge a distance, and the distance represents an installation.

13. A method of tuning an antenna in a tunable antenna system according to claim 1, comprising the steps of consulting the key, identifying a point of adjustment corresponding to an installation, and adjusting the tuning mechanism to the point of adjustment.

14. A tunable antenna system according to claim 1 wherein the predetermined resonant frequency is in the range of 26.95 to 27.405 MHz.

15. A tunable antenna system comprising a set of tunable antennas and a data set, each antenna of the set being tunable within a range of electrical lengths and each datum of the data set representing an installation of an antenna, wherein the ranges of electrical lengths are sufficient to provide resonant frequencies for all installations in the data set and wherein the number of ranges of electrical lengths is less than the number of installations in the data set, whereby fewer antennas are needed than installations possible to provide a tuned antenna for each installation.

16. A tunable antenna system according to claim 15 wherein each datum of the data set represents an installations in a different vehicle model.

17. A tunable antenna system according to claim 16 wherein the vehicle models are trucks.

18. A tunable antenna system according to claim 15 wherein the resonant frequencies are in the range of 26.95 to 27.405 MHz.

* * * * *

UNITED STATES PATENT AND TRADEMARK OFFICE

CERTIFICATE OF CORRECTION

PATENT NO. : 6,791,504 B1
DATED : September 14, 2004
INVENTOR(S) : Paul E. Miller et al.

It is certified that error appears in the above-identified patent and that said Letters Patent is hereby corrected as shown below:

Column 1,
Line 30, "by, the" should be -- by the --.

Column 2,
Line 52, "bounded by 11" should be -- bounded by II --.

Column 4,
Line 20, "resonate If the" should be -- resonate if the --.
Line 38, "an Indicium" should be -- an indicium --.

Column 5,
Line 56, "when Installed on" should be -- when installed on --.

Column 6,
Line 57, "the whole of It." should be -- the whole of it. --.

Column 7,
Line 27, "a predetermined installations" should be -- a predetermined installation --.
Line 30, "installed in a" should be -- installed in an --.

Column 8,
Line 38, "an installations in" should be -- an installation in --.

Signed and Sealed this

Second Day of May, 2006

JON W. DUDAS
*Director of the United States Patent and Trademark Office*